US006315556B1

(12) United States Patent
Stewart

(10) Patent No.: US 6,315,556 B1
(45) Date of Patent: Nov. 13, 2001

(54) TOOTHBRUSH WITH FLUID SUPPLY AND SUCTION

(76) Inventor: Timothy Nathaniel Stewart, 1470 Kastner Pl., Suite 108, Sanford, FL (US) 32771

( * ) Notice: Subject to any disclaimer, the term of this patent is extended or adjusted under 35 U.S.C. 154(b) by 0 days.

(21) Appl. No.: 09/509,370

(22) PCT Filed: Sep. 16, 1998

(86) PCT No.: PCT/GB98/02811

§ 371 Date: Mar. 24, 2000

§ 102(e) Date: Mar. 24, 2000

(87) PCT Pub. No.: WO99/15045

PCT Pub. Date: Apr. 1, 1999

(30) Foreign Application Priority Data

Sep. 25, 1997 (GB) ..... 9720313

(51) Int. Cl.[7] ..... A61G 17/02
(52) U.S. Cl. ..... 433/80; 433/91
(58) Field of Search ..... 433/80, 91; 15/322, 15/167.1; 132/308; 601/162

(56) References Cited

U.S. PATENT DOCUMENTS 1,012,613 * 12/1911 De Witt ..... 433/91
2,150,842 * 3/1939 Oliver .
3,101,545 * 8/1963 Baughan ..... 433/91
4,672,953 * 6/1987 DiVito .
5,062,413 * 11/1991 Bullard ..... 601/162
5,458,563 * 10/1995 Stewart ..... 601/162
5,463,792 * 11/1995 Hogan et al. .
5,484,281 * 1/1996 Renow et al. ..... 433/80
5,573,398 * 11/1996 Towle et al. ..... 433/80

FOREIGN PATENT DOCUMENTS

92/08391 * 5/1992 (WO) .

* cited by examiner

*Primary Examiner*—Todd E. Manahan
(74) *Attorney, Agent, or Firm*—Trexler, Bushnell, Giangiorgi, Blackstone & Marr, Ltd.

(57) ABSTRACT

A toothbrush including a handle that has a first chamber towards a closed end in which is located a bristled head, and access passageways through the bristled head externally of the bristles. The access passageways communicate with the first chamber. A fluid supply line is provided on or in the side of the first chamber from which extend the bristles of the bristled head. The fluid supply line extends into the bristled head and has at least one outlet sited within the confines of the bristles. In addition, there is an air vent to prevent a build up of vacuum in the mouth of the user, located on the side of the first chamber from which extend the bristles of the bristled head. The air vent terminates at one end in close proximity to the bristles to that side of the bristled head, and terminates at the other end at a distance along the length of the handle to ensure that it cannot be fouled by the mouth of a user.

11 Claims, 2 Drawing Sheets

TOOTHBRUSH WITH FLUID SUPPLY AND SUCTION

BACKGROUND

This invention relates to toothbrushes and in particular toothbrushes for use in oral hygiene systems suited for use by bedridden users.

Conventionally, water is applied to the bristled head of a toothbrush to assist the cleaning action of a dentifrice applied to its bristles, and following brushing, it is usual to rinse the mouth. To the able bodied or to those able to sit upright without undue difficulty, cleaning the teeth is not particularly troublesome.

However, when it is the case of a bedridden patient, not able to sit upright, or only able to sit upright with considerable difficulty and discomfort, cleaning the teeth is particularly troublesome, and especially rinsing the mouth, as neither the application of fluid to assist the action of the dentifrice nor subsequent rinsing of the mouth can be effected in conventional manner with the patient in the prone position.

It is known from such as U.S. Pat. No. 4,672,953 to provide a toothbrush with first and second passageway means through the handle for the supply of fluid to the bristles of the brush and its removal from the patient's mouth by suction, in an attempt to overcome the difficulties mentioned above in relation to patients who must, of necessity, remain in a prone position.

However, such a construction still leaves room for improvement in the sense that with prone patients it can frequently occur that the patient's mouth inadvertently closes on to the toothbrush during use causing an unrequired build-up of vacuum during removal of spent fluid. This problem is attended to in European Patent Number 0557337B where a toothbrush construction is provided that ensures that in the circumstance when a patient's mouth does inadvertently close on to the toothbrush there is the substantial guarantee that a vacuum build-up in the mouth is prevented.

SUMMARY

The object of the present invention is to provide a toothbrush construction of simpler and less expensive construction but with at the same time a significantly improved ability to provide and remove fluid and prevent a vacuum build-up.

According to a first embodiment of the present invention a toothbrush comprises a handle having a first chamber towards the closed end in which is located a bristled head, access passageways through the bristled head externally of the bristles, said access passageways communicating with the said first chamber, a fluid supply line provided on or in the side of the first chamber from which extend the bristles of the bristled head, the fluid supply line extending into the bristled head and having at least one outlet sited within the confines of the bristles, and there being in addition an air vent means located on the side of the first chamber from which extend the bristles of the bristled head, the air vent means terminating in close proximity to the bristles to that side of the bristled head.

The first chamber may be formed as a hollow length of brush handle at the end of which is located the bristled head. The fluid supply line may be integrally formed along the inner surface of the face of the handle from which the bristles extend. Alternatively, the supply line may be a separate tube-like item attached to the handle. In either instance the supply line may communicate with a fluid feed passage formed in the bristled head which fluid feed passage extends to at least one fluid outlet that may be centrally located on the head within the bristles.

Whilst an air vent means may be an air passageway formed on the same side of the handle as the fluid supply line, it is preferred to form the air vent means as a separate tube-like member attached to that side of the handle with the inlet in close proximity to the bristles, and the outlet sufficiently distanced from the inlet to ensure that the outlet cannot be fouled by the mouth.

In an alternative construction, where again a hollow handle is provided on which is located a fluid feed tube, the face of the handle from which emerge the bristles may be formed with at least one longitudinal groove one end of which is in close proximity to the bristles and the other end of which is sufficiently distanced therefrom to ensure that it cannot be fouled by the mouth, the depth of the at least one longitudinal groove being such that lips of a user could not compress thereon and hence close the groove.

Whilst the connection to the first chamber is preferably by way of access slots surrounding the bristles of the bristled head, it can be that that connection is formed by a series of small diameter holes in one or both side walls of the handle in the vicinity of the bristled head. Equally, the connection to the first chamber can be by way of both said access slots and said small diameter holes.

According to a second embodiment of the present invention, a toothbrush comprises a handle, a bristle head on the handle from which bristles extend, the bristles being supported by a bristle pad, the bristles being such that they are in close butting relationship with the sides of recess in which the bristle pad is sited, from which recess the bristles emerge, there being a supply line for fluid extending through the handle to the bristle head, said supply line having an outlet emerging directly in the bristles, there being a vacuum connection through the handle extending to the recess in which the bristle head is sited, and there being air vent means located on the handle and extending along the handle from a position in close proximity to the bristles, the air vent means having a number of inlet passageways in longitudinal spaced relationship along the length of the air vent means.

Most desirably, the bristle pad is dimensioned such that it locates in the recess in the bristle head with clearance on all four sides, and it is further desirable that the base of the recess is provided with projections on which the bristle pad sits, to hold the bristle pad clear of the base of the recess.

The vent may be a tube-like member located on the handle, but preferably the vent is formed by at least one and preferably two diametrically opposed passageways within the confines of the handle, with longitudinally spaced access holes through the outer wall of the passageway.

To enable the toothbrush of the invention to be used in conjunction with a machine such as is disclosed in European Patent Number 0557337B, the end of the handle remote from the bristle head may be fashioned as a plug-like connector, the machine being provided with a mating plug-like connector such that the first chamber can be connected to a source of vacuum, i.e., a vacuum pump located on the machine, and the fluid supply line to a source of pressure fluid i.e., to a fluid pump on the machine, by one simple act. It enables a brush to be dedicated to a particular use in the circumstance where it is the machine of European Patent Number 0557337B, and in use as in such as a hospital.

When in use and the first chamber and fluid supply line appropriately connected to a source of vacuum and a source of pressure fluid the brush can be applied to a patients mouth with a most effective provision of fluid and suction to enable the teeth of a prone patient to be cleaned without fluid filling and issuing from the mouth. The presence of air vent means in a most simple and cost effective manner as is described above provides a most effective guarantee that in the event a prone and perhaps comatose users mouth closing on to the handle the air vent means are not blocked and consequently there is the guarantee of the effective removal of fluid from within the mouth and the prevention of an uncomfortable and unwanted build-up of vacuum in the patients mouth.

In its first form of construction, the invention provides a most efficient means of providing a required fluid to the mouth of a patient and its removal whilst ensuring that the inadvertent closing of the mouth of the patient does not cause a build up of vacuum, and in its second form of construction, the disposition of the bristle pad in the recess in the head and their abutting relationship to the sides of the recess is such that there is a major concentration of the vacuum effect directly through the bristles improving noticeably the efficiency of removal of fluid from the patients mouth.

BRIEF DESCRIPTION OF THE DRAWINGS

Two embodiments of the invention will now be described with reference to the accompanying drawings in which.

DESCRIPTION

Figure 1:
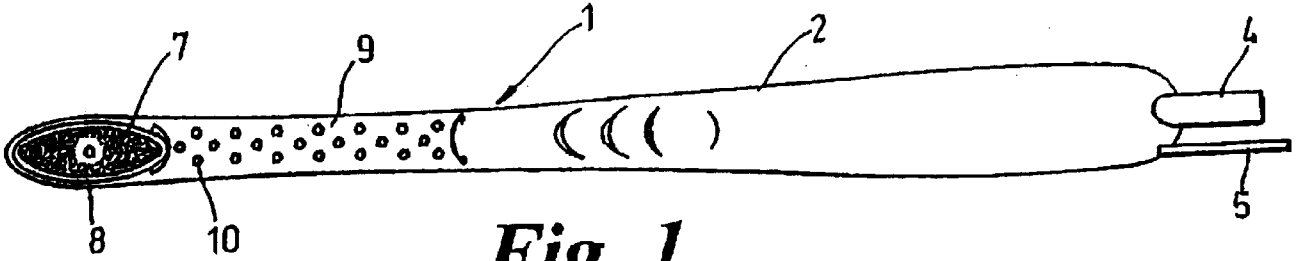
FIG. 1 is a plan view of a first embodiment of toothbrush in accordance with the invention.
Figure 2:
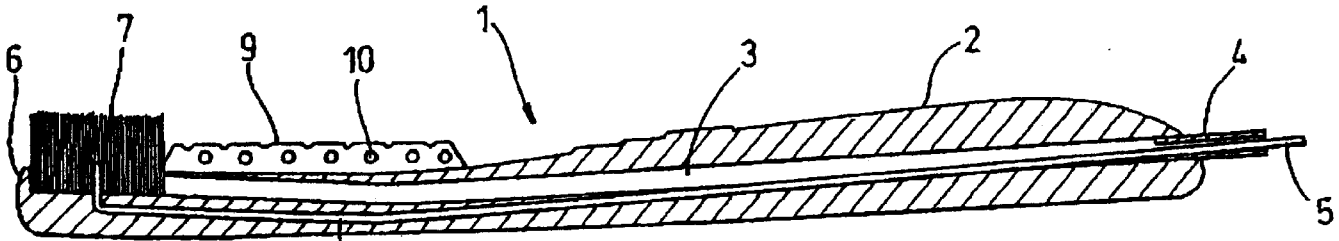
FIG. 2 is a sectional side elevation of the toothbrush of FIG. 1.
Figure 3:
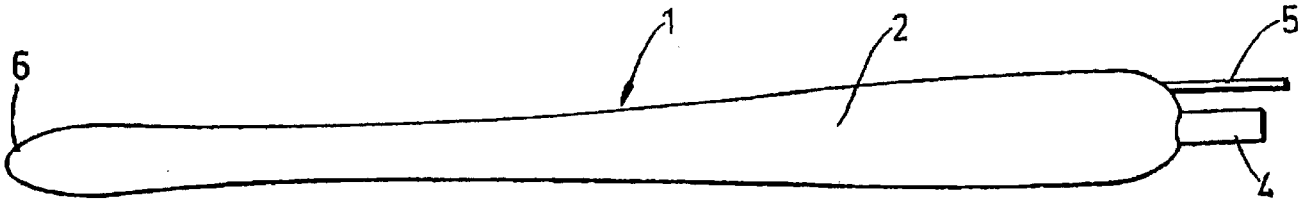
FIG. 3 is an underneath plan view of the toothbrush of FIG. 1.
Figure 4:
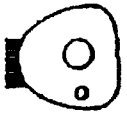
FIG. 4 is an end elevation of the toothbrush of FIG. 1.
Figure 5:
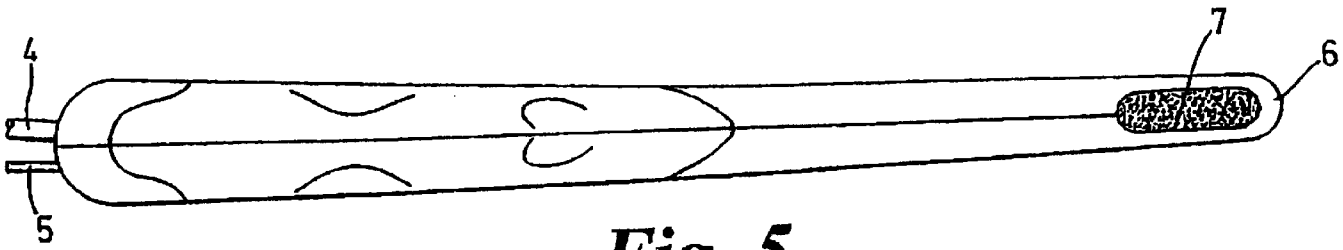
FIG. 5 is a plan view of a second embodiment of toothbrush in accordance with the invention.
Figure 6:
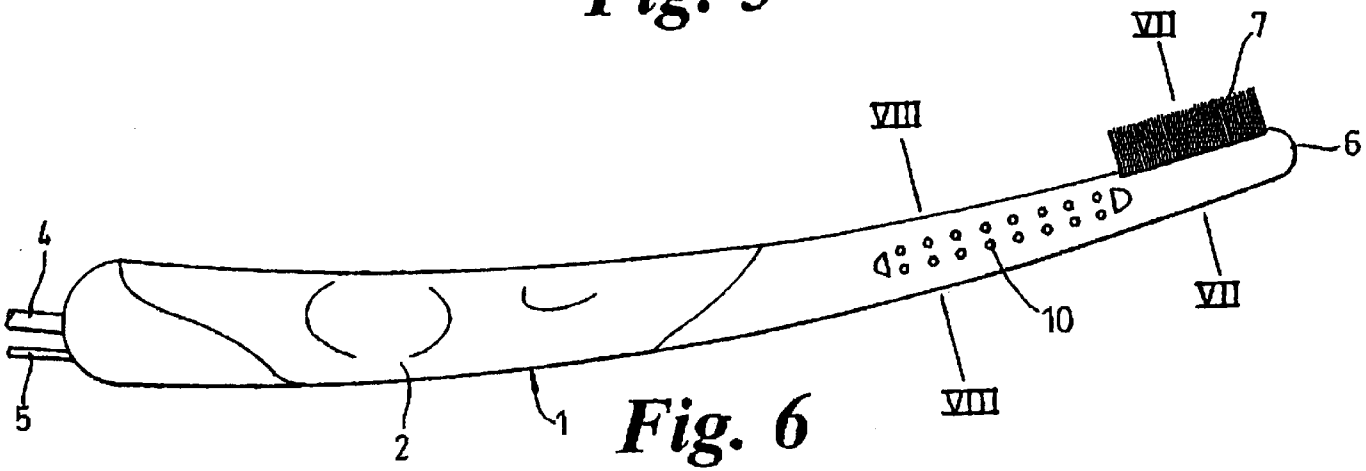
FIG. 6 is a side elevation of the toothbrush of FIG. 5.

In FIGS. 1 to 4, a toothbrush 1 has a first chamber in the form of a hollow handle 2 to provide a passageway 3 for vacuum, there being a connection 4 to the passageway, and to allow its connection to a source of vacuum. Extending through the handle is a fluid supply line 5 for connection to an appropriate source of fluid to be delivered to the mouth of a patient.

At the closed end of the handle is a bristle head 6 in which are located packed bristles 7, the supply line 5 for fluid emerging directly in the centre of the packed bristles. The bristles are surrounded by an area 8 that can be a series of slots or can be a surface through which are provided a series of holes whereby to communicate the area immediately around the bristles with the interior of the bristle head and hence to the passageway 3.

On the surface of the handle, to the side from which the bristles emerge, is a tube-like member 9 having a series of longitudinally spaced holes 10.

In use, and with the connection 4 attached to a source of vacuum and the supply line 5 attached to a source of fluid, the brush can be placed within the mouth of a patient to brush the patients teeth, the simultaneous application of an appropriate fluid and its removal is to the considerable advantage of particularly a prone or comatose patient in allowing a proper cleansing of the teeth without the patient choking or there being spillage of fluid from the patients mouth. In a circumstance where the patients mouth inadvertently closes on to the toothbrush, the length of the tube-like member 9 is such that the patients mouth cannot close beyond its end, and consequently some of at least of the holes 10 will remain exposed to allow air to be drawn into the patients mouth and hence prevent vacuum applied through the bristle head to cause an unwanted build up of vacuum in the mouth of the patient.

In the construction of the second embodiment of FIGS. 5 to 8, like reference numerals are employed for the like components. Here again therefore there is a toothbrush 1, having a handle 2 through which extends a vacuum passage 3 and a supply line 5 for fluid. The fluid supply line again emerges within the bristles 7 at the bristle head 6, and the vacuum line extends to the head to be in close proximity to the bristles. In this form of construction, and as is shown more particularly by FIG. 7, the bristles 7 are provided on a bristle pad 11 that locates in a recess 12 formed in the bristle head. The bristles are so arranged as not only to be densely packed but also to lie in close butting relationship to the sides 13 of the recess from which the bristles emerge. The bristle pad 11 is dimensioned to be smaller than the recess whereby to provide clearance around its periphery, and additionally, mounting means 14 are provided in the recess to locate the bristle pad clear of the base.

Figure 8:
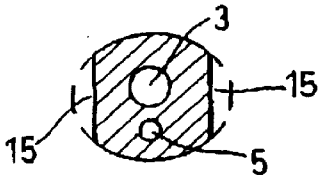
FIG. 8 is an enlarged section on the line VIII—VIII of FIG. 6.
Figure 7:
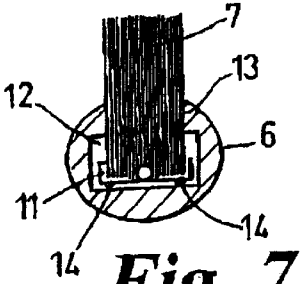
FIG. 7 is an enlarged section on the line VII—VII of FIG. 6.

As is shown by FIG. 8, in place of the presence of a tube-like member 9, longitudinal recesses 15 are provided in the handle, the longitudinal holes 10 being formed through the outer wall of each recess.

In this embodiment it functions in an essentially similar manner to that of FIGS. 1 to 4 allowing the efficient cleansing of a patients teeth and the prevention of and unwanted build-up of vacuum in the mouth of the patient. In the second embodiment, by disposing the bristles on a pad and locating the pad with clearance in a recess, and by having the bristles in close abutting relationship to the side of the recess, there is a major concentration of vacuum through the bristles and the clearance all around the bristle pad is such that there is no essential pressure difference from one side of the bristle array to the other or from one end of the bristle array to the other.

What is claimed is:

1. A toothbrush characterized in that a handle has a bristle head, a recess in the bristle head, bristles extending out of the recess, the bristles being so arranged as not only to be packed densely but also to lie in close abutting relationship to an inwardly directed edge at the top of the recess, there being a supply line for fluid extending through the handle to the recess and emerging directly within the bristles, and there being a vacuum connection through the handle extending to the recess in which the bristles are located.

2. A toothbrush as in claim 1, wherein air vent means are provided located on the handle and extending along the handle from a position in close proximity to the bristles to a position where it cannot be fouled by the mouth of the user, the air vent means having a number of inlet passageways in longitudinal spaced relationship along the length of the air vent means.

3. A toothbrush as in claim 2, characterized in that the air vent means is formed by at least one longitudinal groove on the handle, one end of which is in close proximity to the bristles and the other end of which is sufficiently distanced therefrom to ensure that it cannot be fouled by the mouth.

4. A toothbrush as in claim 1, wherein said recess has a base, and said bristles are at least one of attached to a pad which is disposed in the recess and attached to the base of the recess.

5. A toothbrush characterized by a handle, a bristle head on the handle from which the bristles extend, the bristles being supported by a bristle pad, the bristles being such that they are in close abutting relationship with the sides of recess in which the bristle pad is sited, from which recess the bristles emerge, there being a supply line for fluid extending through the handle to the bristle head, said supply line having an outlet emerging directly in the bristles, there being a vacuum connection through the handle extending to the recess in which the bristle head is sited, and there being air vent means located on the handle and extending along the handle from a position in close proximity to the bristles to a position where it cannot be fouled by the mouth of a user, the air vent means having a number of inlet passageways in longitudinal spaced relationship along the length of the air vent means.

6. A toothbrush as in claim 5, characterized in that the bristle pad is dimensioned such that it locates in the recess in the bristle head with clearance on all four sides, and held above the base of the recess.

7. A toothbrush characterized in that a handle has first chamber towards the closed end in which is located a bristled head, bristles located in a recess on the bristle head, a fluid supply line provided on or in the side of the first chamber, the fluid supply line extending into the bristled head and having at least one outlet sited within the confines of the bristles, the bristles being tightly packed against the sides of the recess, and there being in addition an air vent means to prevent a build up of vacuum in the mouth of a user, located on the side of the first chamber from which extend the bristles of the bristled head, the air vent means terminating at one end in close proximity to the bristles to that side of the bristled head, and terminating at the other end at a distance along the length of the handle to ensure that it cannot be fouled by the mouth of a user.

8. A toothbrush as in claim 7, characterized in that the first chamber is formed as a hollow length of brush handle at the end of which is located the bristled head.

9. A toothbrush as in claim 7, characterized in that the fluid supply line is integrally formed along the inner surface of the face of the handle from which the bristles extend.

10. A toothbrush as in claim 7, characterized in that the supply line is a separate tubelike item attached to the handle.

11. A toothbrush as in claim 7, characterized in that the air vent means is a separate tube-like member attached to that side of the handle with the inlet in close proximity to the bristles, and the outlet sufficiently distanced from the inlet to ensure that the outlet cannot be fouled by the mouth.

* * * * *